US008292378B2

(12) United States Patent
Rosenbauer et al.

(10) Patent No.: US 8,292,378 B2
(45) Date of Patent: Oct. 23, 2012

(54) WASHING CONTAINER FOR A DISH-WASHING MACHINE

(75) Inventors: Michael Rosenbauer, Reimlingen (DE); Helmut Jerg, Giengen (DE); Bernd Schessl, Dillingen (DE); Ernst Stickel, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1775 days.

(21) Appl. No.: 10/603,759

(22) Filed: Jun. 25, 2003

(65) Prior Publication Data

US 2005/0016569 A1 Jan. 27, 2005

Related U.S. Application Data

(63) Continuation of application No. PCT/EP01/14299, filed on Dec. 5, 2001.

(30) Foreign Application Priority Data

Dec. 29, 2000 (DE) ..... 100 65 678

(51) Int. Cl.
*A47B 77/06* (2006.01)

(52) U.S. Cl. ..... 312/228; 312/257.1

(58) Field of Classification Search ..... 312/228, 312/236, 257.1; 134/105, 110, 25.2, 56 D, 134/57 D, 58 D, 200
See application file for complete search history.

(56) References Cited

U.S. PATENT DOCUMENTS

| | | | | | |
|---|---|---|---|---|---|
| 2,311,540 | A | * | 2/1943 | Hastings | 312/228 |
| 3,658,075 | A | * | 4/1972 | Jacobs | 134/107 |
| 5,368,379 | A | * | 11/1994 | Wrangberth | 312/228 |
| 5,605,061 | A | * | 2/1997 | Durazzani | 312/228 |
| 5,660,193 | A | * | 8/1997 | Archer et al. | 134/56 D |
| 5,701,952 | A | | 12/1997 | Stickel | |
| 5,881,576 | A | * | 3/1999 | Davies, Jr. | 312/228 |
| 5,992,954 | A | * | 11/1999 | Becker | 312/228 |
| 6,289,908 | B1 | * | 9/2001 | Kelsey | 312/228 |
| 6,460,949 | B2 | * | 10/2002 | Jung | 312/228 |
| 6,622,740 | B1 | * | 9/2003 | Durazzani | 312/228 |

FOREIGN PATENT DOCUMENTS

| | | | | | |
|---|---|---|---|---|---|
| DE | 7520122 | U1 | | 4/1976 | |
| EP | 0556787 | A1 | | 8/1993 | |
| GB | 1403953 | A | | 8/1975 | |
| GB | 2064309 | A | | 6/1981 | |
| JP | 54012159 | | * | 1/1979 | 312/228 |

* cited by examiner

*Primary Examiner* — Hanh V Tran
(74) *Attorney, Agent, or Firm* — James E. Howard; Andre Pallapies

(57) ABSTRACT

A washing container for a dishwashing machine simplified by attaching at least one cover piece with sidepieces connected at angles to a base frame. The washing container can be assembled in a simpler, less expensive manner.

11 Claims, 4 Drawing Sheets

WASHING CONTAINER FOR A DISH-WASHING MACHINE

The present invention relates to a washing container for a dishwashing machine, which container comprises several parts connected to one another.

DE-U-75 20 122 discloses a container for a dishwashing machine. This known container comprises a cover part U-shaped in plan view to which a floor and lid part are joined. The floor and lid part are attached to the cover part by way of folded joints. This type of structure of a container requires considerable manufacturing expense. In addition, the variation options for a washing container to be constructed matching special, specific applications are strongly limited.

The object of the invention is to design a washing container of the type initially described such that the washing container can be manufactured more easily without considerable expense and in its structure can correspondingly meet the requirements set by the design form of a dishwashing machine.

The solution to this task according to the present invention is that a base frame is provided, in which or around which at least one cover part, comprising side parts connected to each other at an angle, may be introduced or attached. Assembling the washing container is substantially simplified by introducing or attaching the cover part in or on the base frame. Furthermore, if the washing containers are of different heights then the same base frame can always be used. Only the cover part must be designed with a corresponding height. The invention has allowed a washing container of the type initially described to be designed such that the washing container can be manufactured more easily and in its structure can correspondingly meet the requirements set by the design form of a dishwashing machine.

Further simplification of assembly results from the cover part comprising three U-shaped side parts joined to one another. Due to such a U-shaped cover part a washing container can be manufactured more easily, in that another side part, completing the side part missing on the U-shaped cover part is provided on the base frame.

Advantages in manufacture arise from the base frame being designed monobloc and the other side part being formed on the base frame.

A tub-shaped washing container can also be realised by the cover part being designed as a peripherally closed rectangle. At the same time it can be advantageous for manufacturing and costing reasons that the rectangular cover part is formed from L-shaped side part units. Such L-shaped side part units are themselves formed by two side parts 6 joined together at an angle.

Assembly space can be spared if the other side part is fitted with additional functional elements, such as receptacles for rinsing and/or cleaning agents or a device for water softening. Such outfitting of the other side part with additional functional elements is especially simple to achieve if this other side part comprises plastic. Of course, the base frame and the other side part can also be manufactured entirely from plastic material.

It is also advantageous if the base frame is fitted with a floor part designed as a filter.

For space reasons it is also effective for a heat exchanger to be integrated at least in one side part. Due to such a side part designed as heat exchanger not only is space saved, but there is also a saving in assembly costs, because separate assembly of a heat exchanger standard in dishwashing machines is dispensed with. In addition, there is the possibility of designing several side parts as heat exchangers, increasing the capacity for heat recovery.

The invention will now be explained in greater detail with reference to the embodiment illustrated in the diagram, in which.

Figure 1:
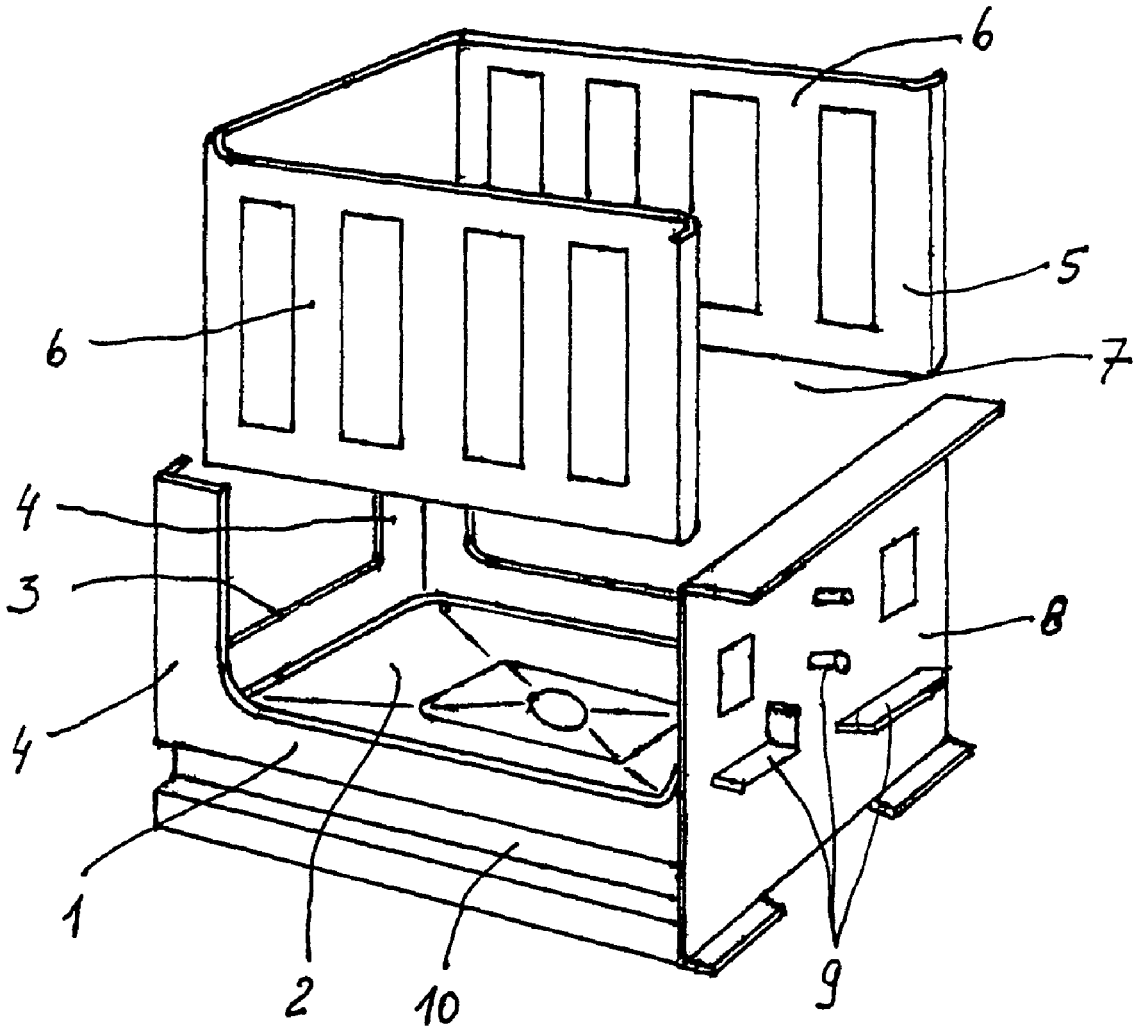
FIG. 1 is an exploded perspective view of one embodiment of the dishwashing machine of the invention.
Figure 2:
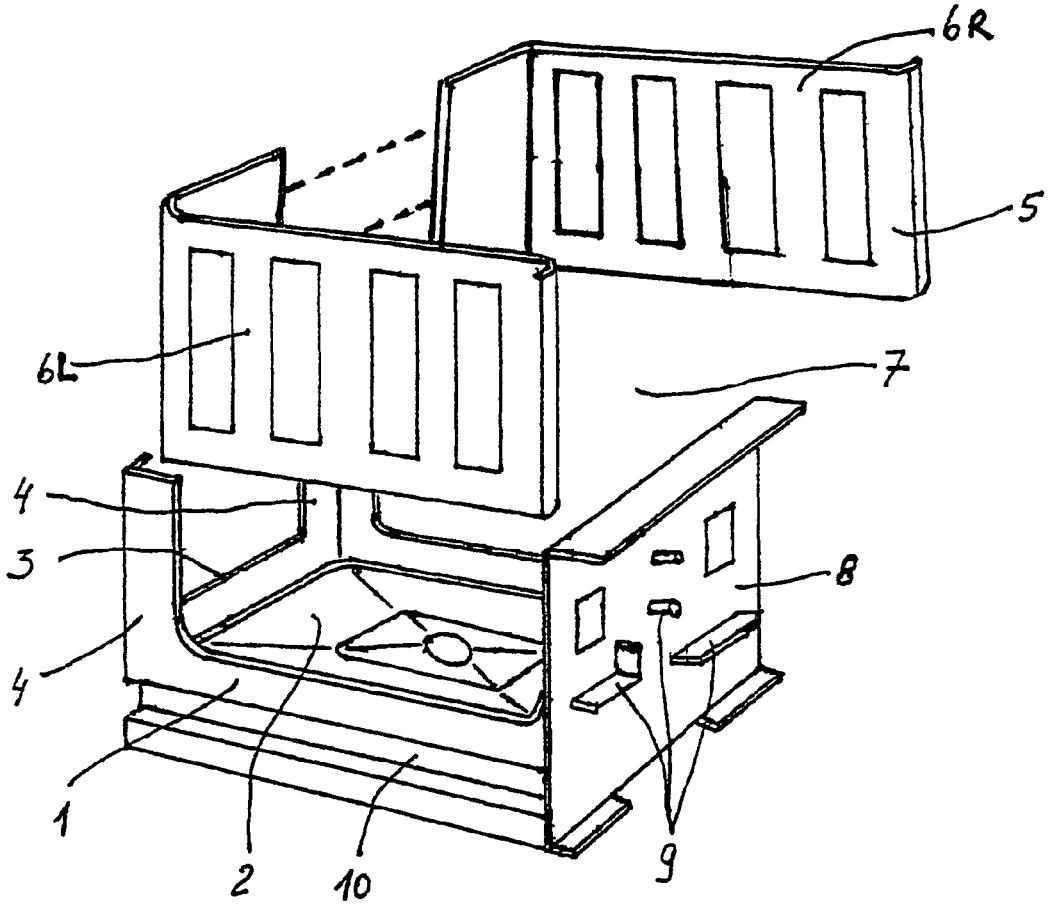
FIG. 2 is an exploded perspective view of a variation of the one embodiment of the dishwashing machine of the invention shown in FIG. 1.
Figure 3:
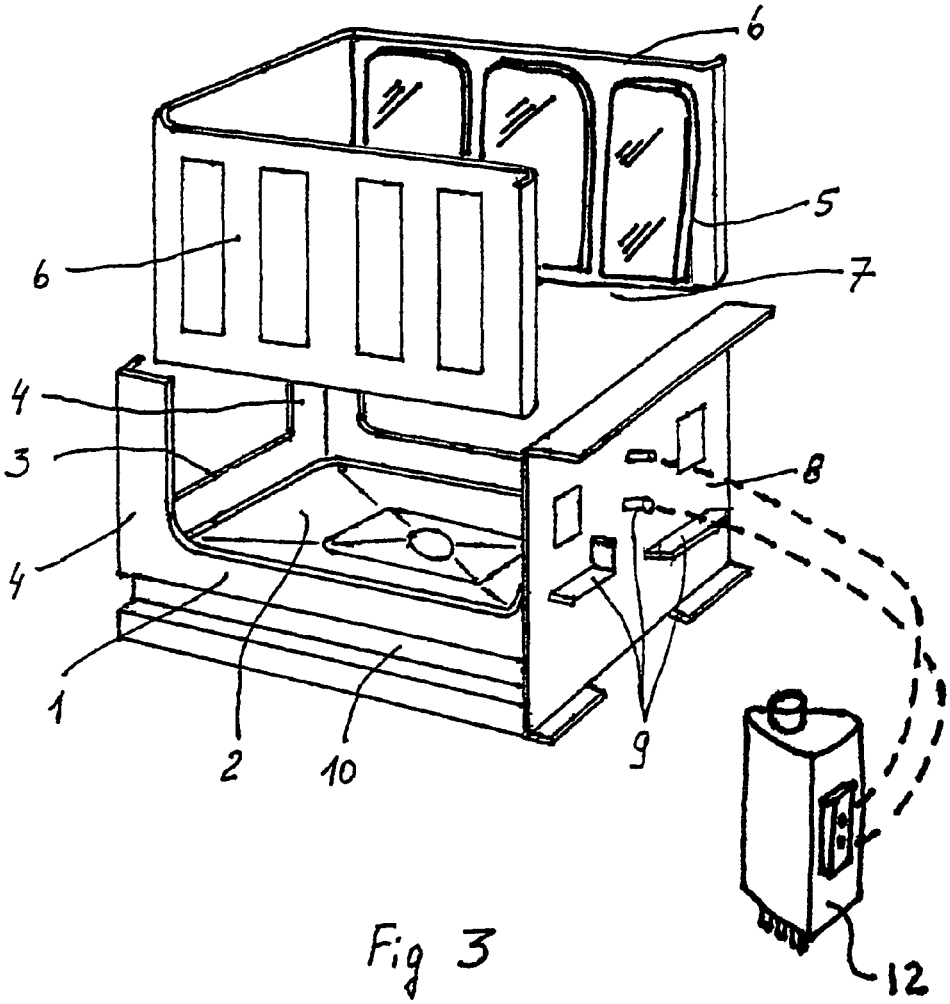
FIG. 3 is an exploded perspective view of another variation of the one embodiment of the dishwashing machine of the invention shown in FIG. 1.

The invention will now be explained in greater detail with reference to the embodiment illustrated in the diagram.

Reference numeral 1 designates a base frame which has a floor part 2 configured as a filter. Formed on one narrow side 3 of the base frame 1 on the floor part 2 are two corner stays 4 extending vertically upwards. The corner stays 4 have an L-shaped or angular cross-section. According to the present invention a base frame 1 is provided, in which or around which at least one cover part, comprising side parts connected to each other at an angle, may be introduced or attached. By means of the abovementioned cross-section a guide and also bracket for a cover part 5, which can be attached to the base frame 1, is formed by the corner stays 4, as illustrated in the embodiment. The cover part can also be attached externally to the base frame.

The cover part 5 comprises three U-shaped side parts 6 connected to one another. To realise a peripherally closed, tub-shaped washing container another side part 8 is provided on the narrow side of the base frame 1 opposite the U-opening of the cover part 5. The other side part 8 can be designed as a separate component and be attached to the base frame 1 in corresponding fashion. But it can also be effective to design the base frame 1 and the other side part 8 as a monobloc plastic component.

A tub-shaped washing container can also be produced by the cover part being formed form two L-shaped side part units. Such L-shaped side part units then each comprise two side parts connected to one another at an angle. For manufacturing reasons such a structure of the washing container can be more favourable.

The other side part 8 is provided with retention elements 9, which can be formed by manufacturing the other side parts 8 from plastic in corresponding fashion. By means of these retention elements 9 additional functional elements, such as containers for rinsing and/or cleaning agents or even a device for water softening, can be attached to the other side part 8. If the washing container is designed as a container which can be withdrawn from the housing of the dishwashing machine, as indicated by the slide grooves 10 provided on the base frame 1, then the additional functional parts can be assembled outside the dishwashing machine housing, which is easily possible due to the free access to the other side part 8.

One or more side parts 6 of the cover part 5 can be designed as heat exchanger. Again, separate assembly of such a heat exchanger standard in dishwashing machines does not apply. Also, less space is required for accommodating a heat exchanger. Due to several side parts 6 being designed as heat exchangers the degree of heat recovery and/or condensation effect in a drying procedure is substantially heightened.

Figure 4:
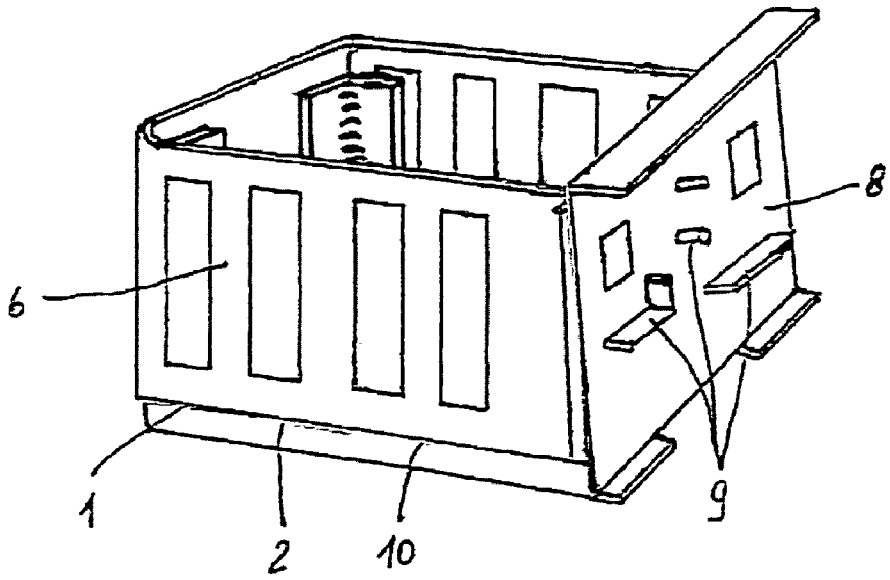
FIG. 4 is an exploded perspective view of a further variation of the one embodiment of the dishwashing machine of the invention shown in FIG. 1.

FIG. 4 shows a variation of the one embodiment of the dishwashing machine of the invention shown in FIG. 1, wherein, as seen in FIG. 4, the cover part 5 is attached externally to the two upstanding corner stays 4 of the base frame 1.

The modular structure of the washing container also enables, when this seems effective, different materials to be used for the base frame 1 and the cover part 5.

The base frame 1 can effectively comprise plastic and the cover part 5 can comprise stainless steel or any other corrosion-resistant material.

Due to the modular structure of the washing container alterations to the dimensions of the washing container can be carried out more simply and more cost-effectively. Various heights for the washing containers can be achieved e.g. simply by corresponding changes to the dimensions of the cover part 5.

It has been possible with the invention to design a washing container of the type initially described, such that the washing container can be manufactured more simply and without considerable expense and in its structure can correspondingly meet the requirements set by the design form of a dishwashing machine.

The invention claimed is:

1. A washing container for a dishwashing machine, comprising:

a container body including a plurality of assembled parts;

a base frame part; and at least one cover part attached to said base frame part, said cover part including a plurality of side parts, said side parts connected to one another at an angle to form said cover part, wherein said cover part is formed substantially in the shape of a peripherally closed rectangle and said peripherally closed rectangle cover part is formed from two substantially L-shaped side parts.

2. The washing container according to claim 1, said cover part including three side parts connected to one another to form a substantially U-shaped cover part having an open end.

3. The washing container according to claim 2, said base frame part having an upstanding side part, said upstanding side part located in said U-shaped cover part open end completing said cover part.

4. The washing container according to claim 3, said base frame part and said upstanding side part formed as a unitary assembly.

5. The washing container according to claim 4, said base frame part and said upstanding side part unitary assembly formed from a molded plastic material and said cover part formed from a corrosion-resistant material.

6. The washing container according to claim 3, said upstanding side part including additional retention functional elements, including at least one receptacle retention element for one of a rinsing or cleaning agent or a water softening device.

7. The washing container according to claim 1, said base frame part including a filter floor part.

8. The washing container according to claim 1, at least one of said side parts including a heat exchanger integrated therein.

9. A washing container for a dishwashing machine, comprising:

a container body including a plurality of assembled parts;

a base frame part, said base frame part having a floor part and at least two upstanding corner stays, wherein said base frame part includes an upstanding side part, said upstanding side part located in said substantially U-shaped periphery of said cover part completing said cover part, wherein said upstanding side part includes additional retention functional elements, including at least one receptacle retention element for one of a rinsing or cleaning agent or a water softening device; and at least one cover part attached to said base frame part, said cover part including a plurality of side parts, said side parts connected to one another at an angle to form a substantially U-shaped periphery of said cover part, said substantially U-shaped periphery of said cover part having an open end and a closed end opposite said open end, and said cover part being attached to said base frame part with its U-shaped periphery mounted on said floor part of said base frame part and said cover part being attached at a respective one of its open end and its closed end to said at least two upstanding corner stays.

10. The washing container according to claim 9, wherein said cover part is attached externally to said at least two upstanding corner stays of said base frame part.

11. The washing container according to claim 9, wherein said cover part is attached internally to said at least two upstanding corner stays of said base frame part.

* * * * *